US005732489A

United States Patent [19]

Udelle et al.

[11] Patent Number: 5,732,489

[45] Date of Patent: Mar. 31, 1998

[54] ELECTRIC IRON HEM GAUGE DEVICE

[76] Inventors: Steven D. Udelle; Laura L. Udelle, both of 13 Seasons Dr., Punta Gorda, Fla. 33983-5432

[21] Appl. No.: 818,356

[22] Filed: Mar. 17, 1997

Related U.S. Application Data

[63] Continuation of Ser. No. 671,443, Jun. 27, 1996, abandoned.

[51] Int. Cl.[6] ..... D06F 79/00; D06F 75/30

[52] U.S. Cl. ..... 38/94; 38/88; 38/141; 33/2 H; 223/36

[58] Field of Search ..... 38/79, 88, 93, 38/94, 113, 141; 112/217, 141, 146, 235, 143; 33/2 H, 2 R, 512, 8; 223/34, 35, 36

[56] References Cited

U.S. PATENT DOCUMENTS

| | | | |
|---|---|---|---|
| 526,926 | 10/1894 | Littell | 33/2 H |
| 778,083 | 12/1904 | Strauss | 38/94 X |
| 945,432 | 1/1910 | Yost | 38/94 X |
| 2,432,588 | 12/1947 | Roosevelt | 112/143 |
| 5,590,821 | 1/1997 | Reber | 223/35 X |

OTHER PUBLICATIONS

Clotilde, Measuring Tools, hand held depth hem marker, p. 46, Fall 1995.

Solo, Sewing and Tailor Needs, Books, Press–Mate Ironing Board Cover, p. 29, Jun. 1992.

*Primary Examiner*—Ismael Izaguirre

[57] ABSTRACT

An electric iron device that employs indicia markings along both sides of an iron sole-plate used for accurately gauging and pressing any desired width of hem or cuff of a fabric, thereby eliminating the need for basting the fabric prior to pressing. The spaces between the indicia marks are alternately colored to provide an easy visual guide reference when pressing the hem fold to a desired width.

21 Claims, 2 Drawing Sheets

ELECTRIC IRON HEM GAUGE DEVICE

This application is a continuation of application Ser. No. 08/671,443, filed Jun. 27, 1996 now abandoned.

FIELD OF THE INVENTION

The present invention deals with electric iron accessories and more particularly to electric iron attachments that simplify the preparation of hems, cuffs, and the like for sewing.

BACKGROUND-DISCUSSION OF THE PRIOR ART

SOLO SEWING AND TAILORING CATALOG, June 1992, page 29, shows a Press-Mate Ironing Board Cover illustrating a grid of squares with a rule and yardage indicator for sewing and pressing fabrics. CLOTILDE SEWING CATALOG, Fall of 1995, page 46, shows a Dritz EZY-HEM Marker for gauging hem lines prior to pressing. This device requires holding the hem marker and Folding the material over it at the same time prior to pressing with an iron. This device is awkward to use, requiring a third hand as with all current accessory hem gauges. There are many methods of making or preparing hems with devices as illustrated in WHOLE SEWING CATALOG, 1979, by Publications International, LTD., distributed by Butterick Publishing, pages 195 to 201, and SINGER SEWING BOOK, 1972, by Singer Sewing Company, by Western Publishing Company, pages 187 to 197. Applicants' present invention simplifies hem and cuff folds without the use of glue, chalk, soapstone, pins or loose and portable hem gauges. When cutting material from patterns, the raw fabric edge is cut evenly to the pattern edge, giving the device a clean edge to follow for pressing of the hem and the like. Most modern home sewing machines have a hemmer foot which is suitable only for narrow hems. Seam or hem guide attachments still require a pre-pressed hem fold for accurate sewing results.

SUMMARY OF THE INVENTION

It is well known that when preparing hems, cuffs, and the like, the material is loosely basted with thread or spaced pins prior to ironing the material. Basting is time consuming and the straight pins or needles leave small holes in delicate material when removed, thus detracting from the finished appearance of certain fabrics. Generally, the present invention is comprised of graduated indicia, or markings on the side portion of an electric iron sole-plate heat element. The scale markings may be in one-quarter inch increments to simplify single or double folds of hem or cuff widths. Simply fold the material to be hemmed with one hand, while gliding the iron at a right angle to the length of the hem with the other hand, and the desired width of the fold is easily assured when matched to the selected colors or scale marks on the iron sole-plate.

COMPLETE DESCRIPTION OF THE INVENTION

Figure 1:
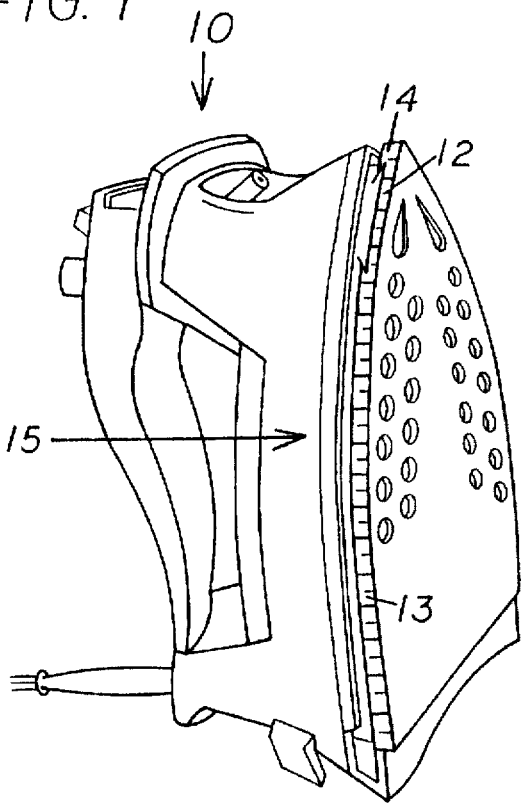
FIG. 1 shows a perspective view of a typical electric iron with engraved markings or indicia on the side portion of tile iron sole-plate.

FIG. 1 is a perspective view of a typical electric iron assembly 10 having evenly spaced indicia marks 12 on both sides of the iron sole-plate heat element 14. The sole-plate heat element 14 may be manufactured with engraved or embossed indicia marks 12, or an adhesive strip with indicia marks may be added to the sole-plate side that would be able to withstand the high temperature. The indicia spaces 13 are alternately colored for easier gauging of the desired width of the cuff or hem. For example, at area 15, two adjacent spaces are colored pink to represent ½ inch; one space to the left and right of pink are colored blue to represent one inch; one space to the left and right of blue are colored yellow to represent one and one-half inches; and one space to the left and right of yellow are colored green to represent two inches, and so on. The longitudinal length of the iron is moved at a right-angle across the length of the cuff or hem. The present invention permits rapid and accurate hem or cuff folds, achieved without the need of time-consuming basting or pinning of the material prior to ironing and sewing. Many fabrics retain pin holes from basting, detracting from the appearance of the completed work. The temperature setting of the iron may be such that the iron may be slowly moved as the hem-fold is made without damage to the fabric. A steam iron is preferred to provide a sharper set to the folded edge.

Figure 2:
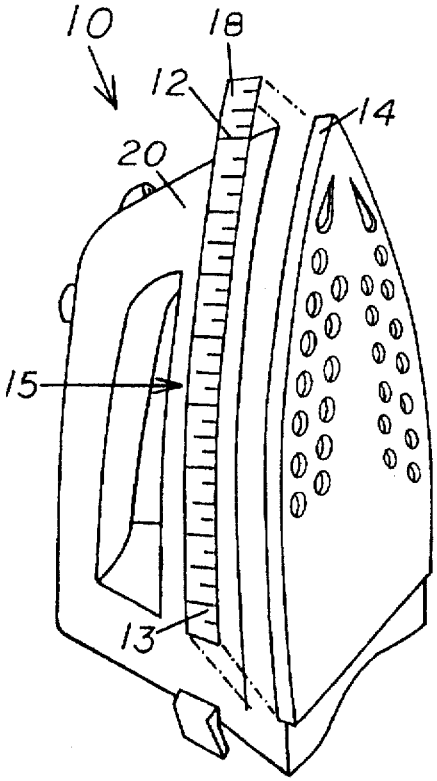
FIG. 2 is an exploded perspective view of an alternate embodiment of FIG. 1 showing a marking method utilizing an add-on or permanent indicia engraved on the heat-resistant strip portion of the iron housing.

FIG. 2 is an exploded perspective view of an alternate embodiment of FIG. 1 showing electric iron assembly 10 having evenly-spaced indicia marks 12 embossed or engraved on both sides of the lower iron housing's 20 heat-resistant strip 18 shown in an exploded view. The heat-resistant strip portion 18 of housing 20 may be manufactured integrally with the indicia marks, or an adhesive strip with indicia marks may be added to the heat-resistant strip portion 18. The indicia spaces 3 at area 15, are alternately colored for easier gauging of the desired width of the cuff or hem as outlined in FIG. 1. The advantages of this alternate are the same as described in FIG. 1, except that the temperature of the heat-resistant strip portion 18 is cooler than the sole-plate 14 temperature.

Figure 3A:
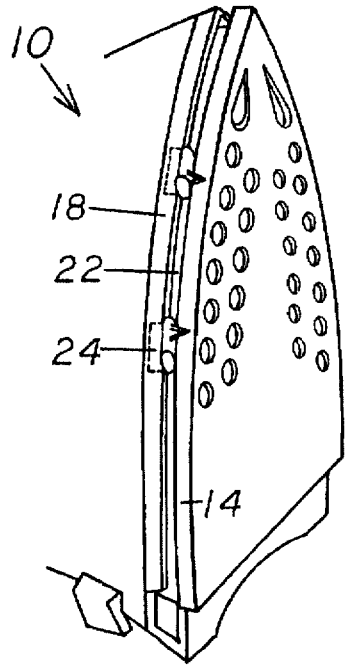
FIG. 3*a* is a perspective view of another alternate embodiment of FIG. 1 showing a sole-plate and heat resistant housing portion utilizing a slideable pointer gauge inserted in the open air space slot between the sole-plate and heat resistant strip portion of the iron housing.

FIG. 3*a* is a perspective view of another alternate embodiment of FIG. 1 showing a portion of electric iron assembly 10. The air space 22 between sole-plate 14 and heat-resistant strip 18 is employed as a track or guide for a plurality of slideable friction pointer gauges 24. The pointer gauges may be manufactured permanently into the iron assembly 10 or removably attached as an after-market add-on. The pointer gauges slideably adjust to any hem or cuff width within the iron's length.

Figure 3B:
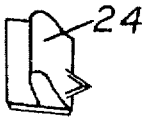
FIG. 3*b* is a perspective view of the slideable pointer gauge.

FIG. 3*b* is a perspective view of a typical slideable pointer gauge 24 of FIG. 3*a*.

Figure 4A:
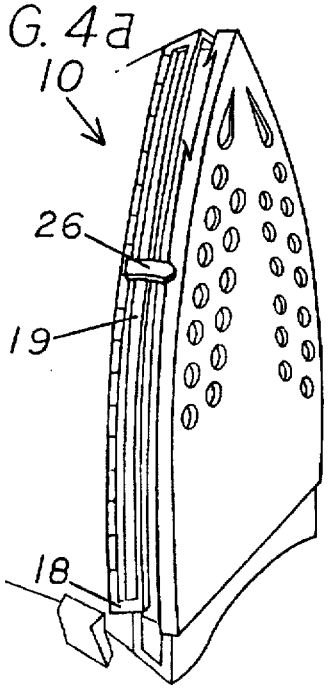
FIG. 4*a* is a perspective view of another alternate embodiment of FIG. 1 of an iron sole-plate with a heat resistant housing strip having an elongated slot to accommodate a slideable pointer gauge.

FIG. 4*a* is a perspective view of another alternate embodiment of FIG. 1 showing a portion of electric iron assembly 10. Heat-resistant strip 18 is provided with a slotted opening 19 along a substantial portion of its length. The slotted opening 19 employs a plurality of slideable friction pointer gauges 26 on both sides of heat-resistant strip 18. The function of the pointer gauges are the same as described in FIG. 3*a*, except that the gauges are cooler to the touch.

Figure 4B:
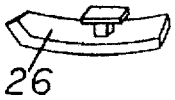
FIG. 4*b* is a perspective view of the slideable pointer gauge.

FIG. 4*b* is a perspective view of a typical slideable friction pointer gauge 26 of FIG. 4*a*.

Figure 5A:
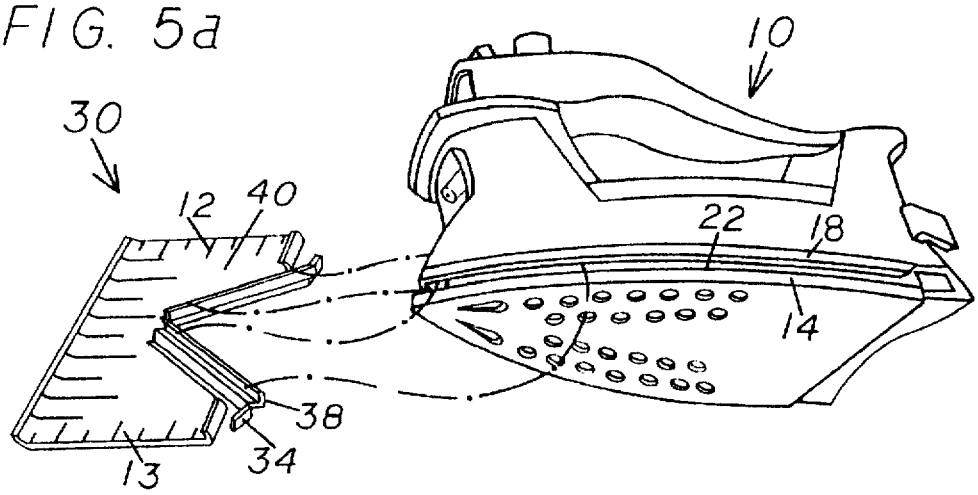
FIG. 5*a* is an exploded perspective view of another alternate embodiment of FIG. 1 showing a removably attached hem or cuff gauge that clamps to the button groove by spring tension.

FIG. 5*a* is an exploded perspective view of another alternate embodiment of FIG. 1 showing an electric iron assembly 10 employing a removably attached hem or cuff gauge assembly 30. Hem gauge assembly 30 may be manufactured and packaged with the electric iron or provided as an after-market accessory. Assembly 30 is designed for existing irons having an air space 22 between the top sole-plate heat element edge 14 and the bottom heat-resistant strip 18 with or without a button groove. Assembly 30 is comprised of a fabric holding member 40 provided with indicia marks 12, alternately colored indicia spaces 13, a pair of spring-like arms 34, a vertical edge 38 for insertion and gripping behind the inside lower edge of heat-resistant strip 18 within air space 22.

Figure 5B:
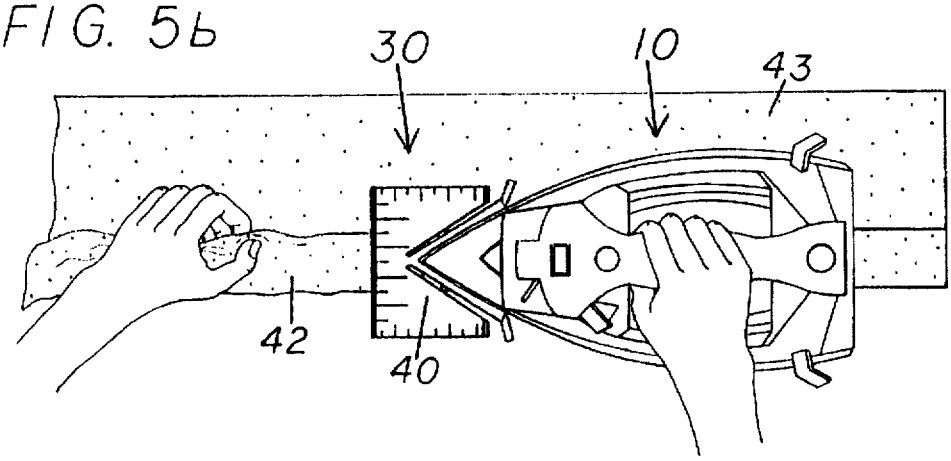
FIG. 5*b* is a top plan view of FIG. 5*a* illustrating the application of the removably attached hem gauge.

FIG. 5*b* is a top plan view of FIG. 1 illustrating the application of assembly 30. Assembly 30, affixed to electric iron assembly 10, is simply moved longitudinally along the length of the manually prepared fold 42 of of fabric 43. Gauge member 40 holds the fold 42 to the selected indicia colors or marks in preparation to contacting the steam iron.

Figure 6:
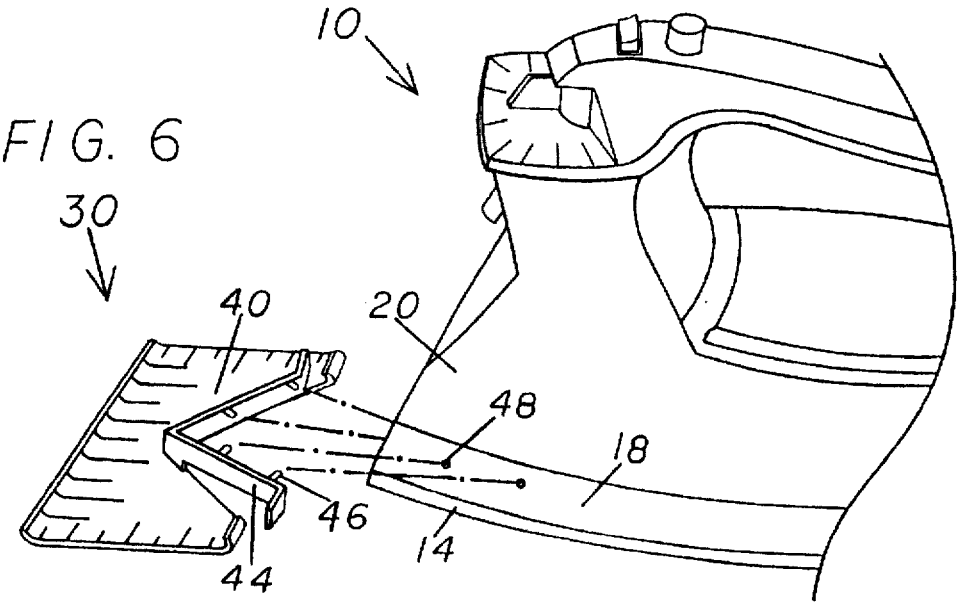
FIG. 6 is an exploded view of another alternate embodiment of FIG. 1 showing a removably attached hem gauge with attachment pins.

FIG. 6 is an exploded perspective view of another alternate embodiment of FIG. 1 showing an electric iron assembly 10 without an air space 22 as shown in FIG. 3*a* between the top edge of sole-plate heat element 14 and lower edge of heat-resistant strip 18. Gauge assembly 30 may be manufactured and packaged with the electric iron or provided as an after-market accessory. A removable adhesive template is provided with hole markings for drilling a plurality of small holes 48 into the metal, plastic, or heat-resistant strip of iron housing 20. The plurality of pins or dowels 46 affixed to spring-like arms 44 of gauge assembly 30 are inserted into pin openings 48 and hold the gauge assembly firmly in place. The bottom side of member 40 is firmly held to the same plane as the bottom side of the iron sole-plate 14. This gauge assembly can be effectively attached to any existing iron of old or new manufacture. Thus it has been shown that the present invention simplfies gauging and pressing a hem edge accurately to a desired width easier and faster than existing gauge devices for sewing and crafting projects.

While the above descriptions may contain many specific details, these teachings should not be construed as limitations on the scope of the invention, but rather as examples of embodiments or modifications, herein detailed in accordance with the descriptive requirements of law. It should be understood that the details are to be interpreted as illustrative and not in a limiting sense.

We claim:

1. An electric iron hem gauge device comprising:

a) an electric iron assembly having a sole-plate heat element comprising a top surface, an upper edge, a lower edge, a bottom surface, a left exposed side surface, a right exposed side surface, and a front-most exposed surface below the electric iron housing;

b) said electric iron housing having a top surface, a lower edge, a left exposed side surface, a right exposed side surface, and a front-most exposed surface; and c) means affixed to at least one said surface of said electric iron assembly for gauging a preselected hem width while in the act of pressing a crease in said hem width, thereby eliminating the need to baste said hem width beforehand.

2. The device of claim 1, wherein said means affixed to said surface comprises spaced indicia marks displayed on said exposed side surfaces of said electric iron heat element.

3. The device of claim 2, where in the spaces between said spaced indicia marks further includes preselected colors for easier visual reference in making a quick, accurate pressed hem fold width.

4. The device of claim 1, wherein said means affixed to said surface, comprises an elongated spaced indicia-marked gauging strip affixed longitudinally to said left exposed side surface and said right exposed side surface of said electric iron housing adjacent to said lower edge.

5. The device of claim 4, wherein said spaced indicia-marked strip is affixed longitudinally to said left exposed side surface, and said right exposed side surface of said electric iron housing adjacent to said lower edge, and includes means for employing at least one slideable gauge pointer on said left exposed side surface, and said right exposed side surface of said electric iron housing for setting said slideable gauge pointer for a preselected hem fold width.

6. The device of claim 5, wherein said means employing said slideable gauge pointer comprises an elongated slotted opening, longitudinally employed at said left exposed side surface, and said right exposed side surface of said electric iron housing adjacent to said lower edge, said slotted opening longitudinally adjacent to said spaced indicia-marked strip.

7. The device of claim 6, wherein said slotted opening on said left exposed side surface and said right exposed side surface of said electric iron housing further includes a plurality of slideable gauge pointers at said slotted opening adjacent to said lower edge.

8. The device of claim 7, wherein said plurality of slideable gauge pointers at said slotted opening adjacent to said lower edge of said housing have sufficient pointer lengths extending downwardly to said heat element said left exposed side surface, said right exposed side surface, and said frontmost exposed surface for gauging pressed hem widths.

9. The device of claim 1, wherein said means affixed to said surface of said electric iron assembly, comprises a projecting horizontal hem gauge member, said hem gauge member having means at its rearmost portion for being removably attached to said frontmost exposed surface of said electric iron assembly.

10. The device of claim 9, wherein said hem gauge member is rectangular in shape and employs said spaced indicia marks on its upper surface and, said means at its rearmost portion for being removably attached comprises at least one elongated arm arranged rearward of said hem gauge member having a plurality of projecting extensions on said elongated arm that mate into a plurality of openings in said frontmost exposed surface of said electric iron assembly.

11. The device or claim 10 wherein said at least one elongated arm arranged rearward of said hem gauge member, further includes a plurality of said elongated arms comprised of a spring-like material for firmly gripping onto said electric iron assembly, thereby insuring that the bottom horizontal surface of said hem gauge member is firmly even with said bottom surface of said heat element.

12. The device of claim 11, wherein said plurality of openings in said frontmost exposed surface of said electric iron assembly may be added to other irons by use of an adhesive hole-making template, thereby utilizing said hem gauge member on after-market irons.

13. An electric iron hem gauge device comprising:

a) an electric iron sole-plate heat element having an upper edge, a lower surface, a left exposed side surface, and a right exposed side surface below the electric iron housing;

b) said electric iron housing having a lower edge, a left exposed side surface and a right exposed side surface;

c) said left exposed side surface and said right exposed side surface of said electric iron sole-plate heat element display spaced indicia marks for gauging a preselected hem width while in the act of pressing said hem width, thereby eliminating the need to baste said hem width beforehand.

14. The device of claim 1, further includes at least one slideable gauge pointer employed between said upper edge of said heat element, and said lower edge of said electric iron housing having the pointed end sufficiently near to said lower edge of said heat element.

15. The device of claim 14, wherein said slideable gauge pointer further includes a plurality of slideable gauge pointers employed at said left exposed side surface, and said right exposed side surface of said heat element.

16. The device of claim 4, wherein the spaces between said spaced indicia marks further include preselected colors for easy reference to dimension widths for hem folds.

17. The device of claim 16, wherein the spaces between said spaced indicia marks have preselected colors for easier visual reference in making a quick, accurate, pressed hem fold.

18. The device of claim 1, further comprises an open space between said lower edge of said electric iron housing and said upper edge or said electric iron heat element along both sides or said electric iron.

19. The device of claim 18, wherein said open space receives at least one removably attached slideable gauge pointer for each side of said electric iron.

20. The device of claim 19, wherein said removably attached slideable gauge pointer is friction-fitted behind said electric iron housing's lower edge and said heat element upper edge, thereby providing an after-market add-on accessory for quickly gauging and pressing hem fold widths.

21. The device of claim 20, further includes an elongated indicia-marked strip affixed to said left exposed side surface, and said right exposed side surface of said electric iron housing longitudinally adjacent to said open space, said indicia-marked strip provides an after-market add-on accessory for gauging pressed hem fold widths when used with said after-market slideable gauge pointers.

* * * * *